US006607122B1

(12) United States Patent
Ong

(10) Patent No.: US 6,607,122 B1
(45) Date of Patent: Aug. 19, 2003

(54) COMBINED DETACHABLE FILING WALLET DEVICES

(76) Inventor: Bon S. Ong, Box 4247, Torrance, CA (US) 90510

( * ) Notice: Subject to any disclaimer, the term of this patent is extended or adjusted under 35 U.S.C. 154(b) by 0 days.

(21) Appl. No.: 10/098,118

(22) Filed: Mar. 15, 2002

(51) Int. Cl.[7] ..... B65D 27/00
(52) U.S. Cl. ..... 229/67.3; 229/67.4; 150/113
(58) Field of Search ..... 229/67.1, 67.3, 229/67.4, 72; 150/113; 190/110, 111

(56) References Cited

U.S. PATENT DOCUMENTS

| | | | | | |
|---|---|---|---|---|---|
| 325,676 | A | | 9/1885 | Jenkins | |
| 975,792 | A | | 11/1910 | Pittman | |
| 1,455,419 | A | | 5/1923 | Ahlquist | |
| 2,333,798 | A | | 3/1943 | Kner | |
| 2,316,328 | A | * | 4/1943 | Guenther et al. | 190/124 |
| 2,612,199 | A | * | 9/1952 | Schocket | 150/112 |
| 2,691,400 | A | * | 10/1954 | Giordano | 190/111 |
| 3,410,376 | A | * | 11/1968 | Benzel | 190/110 |
| 4,250,938 | A | * | 2/1981 | Siegel | 150/111 |
| 4,262,838 | A | | 4/1981 | Mackensie | |
| 4,274,577 | A | | 6/1981 | Walsh, Jr. | |
| 5,271,502 | A | | 12/1993 | Chang | |
| 5,664,724 | A | | 9/1997 | Ho | |
| 5,875,876 | A | * | 3/1999 | Wang | 190/18 A |
| 6,502,742 | B1 | * | 1/2003 | Su | 229/67.3 |

* cited by examiner

*Primary Examiner*—Jes F. Pascua
(74) *Attorney, Agent, or Firm*—Charles H. Thomas

(57) ABSTRACT

A portable document storage device includes large and small portable file folders or wallets. Each of these file folders has front and back covers and a foldable flap that extends from the back cover and folds over the front cover. Each file folder is provided with accordion pleated side panels that allow at least the upper portions of the front and back covers to be spread apart from each other for access to the contents of the folders. A plurality of divider sheets are provided for each file folder. The divider sheets have side marginal edges that are secured throughout to the pleats in the side panels of their respective wallets. Release able fasteners are provided with mutually engaging fastening elements located near the upper edge of the rear cover of the small filing wallet and near the upper edge of the front cover of the large filing wallet. The small filing wallet can thereby be detachable secured to the front of the large filing wallet and the two wallets can be utilized together and enclosed by the filing flap of the large filing wallet. Alternatively, the small wallet may be totally detached from the large wallet and the two wallets may be utilized independently from each other.

20 Claims, 9 Drawing Sheets

34
26
54
44
52
78
82
22
84
16
78
52
62
60
48
70
74
58
20
14
64
68
54
72
12
48
10
18
32
54

COMBINED DETACHABLE FILING WALLET DEVICES

BACKGROUND OF THE INVENTION

1. Field of the Invention

The present invention relates to a portable document storage device that includes large and small filing wallets which may be utilized together or separately from each other. The smaller wallet has release able fasteners near the upper edge of its back cover that are detachable from corresponding fasteners near the upper edge of the front cover of the larger wallet. The closure flap of the larger wallet encloses the smaller wallet within the larger wallet when the smaller wallet is attached to the larger wallet.

2. Description of the Prior Art

At present, portable document storage devices, such as filing wallets, are designed to accommodate documents of different sizes. A relatively large filing wallet, for example, may be fabricated so as to accommodate full size sheets of paper, such as paper measuring 8½by 11 inches. This size is widely utilized in the United States and Canada. On the other hand, it is sometimes more convenient for a smaller wallet to be utilized to store or transport folded sheets of paper, such as letters, business checks, and other smaller papers.

At present, individuals that travel frequently must either store business papers within a wallet or a folder of an inappropriate size, or keep track of more than one wallet or filing folder. Also, smaller sized wallets, although very convenient for portability purposes, often become misplaced when briefcases and articles of luggage are packed and unpacked. Consequently, a person may inadvertently fail to bring a smaller size business filing wallet to an important meeting or presentation.

SUMMARY OF THE INVENTION

The present invention provides a convenient system for storing and transporting documents in filing wallets and pouches of different sizes, yet also provides a means for attaching such devices together and transporting them as a unit. More specifically, the system of the present invention employs two detachable filing wallet devices of different sizes. Both wallets are configured to have expandable pockets created by side panels folded from top to bottom with accordion folds. The user is thus able to compactly store documents within the collapsed filing pockets in the wallet of appropriate size for ease and convenience in transporting a plurality of different size documents. When the user wishes to withdraw the documents from the file, the expandable sides of the expandable wallet filing devices allow the top openings of the wallets to be spread wide, so that the user can easily find particular papers or other articles within the wallet.

The smaller or minor wallet of the invention may be formed as a pouch having a back cover, a front cover, and a folding closure flap. At least the back cover and closure flap are formed from a common sheet of stiff, but flexible protective material, such as polypropylene or polyethylene plastic. An articulated fold delineates the back cover from the folding flap of the small or minor wallet. A plurality of small file section dividers separate the contents of the small wallet into suitable filing categories. The small wallet may be closed by folding over the closure flap from the top of the back cover to cover the front cover. Some closure device, such as an elastic loop attached to the folding flap near its free edge may be utilized to hold the small or minor wallet closed shut.

Release ablefasteners, such as flexible hook and loop interchangeable fastening pads sold under the registered name Velcro®, or metal snap fastening devices, are provided to allow the small wallet to be attached to a larger wallet of similar construction. The detachable fasteners on the back cover of the small wallet are positioned for selective engagement with corresponding fastening members on the front cover of a larger expandable folding wallet. The release able fasteners allow the two wallets to be united together in a fully detachable manner for ease of transport. Furthermore, the engage able attachment feature aids in preventing the small or minor wallet from becoming lost or misplaced, since it is attached to and enveloped within a filing device of considerably larger size. Nevertheless, the smaller wallet may be completely detached and removed from the larger filing wallet, if desired.

In one broad aspect the present invention may be considered to be the combination of a large filing wallet with a small filing wallet. The large filing wallet has a large front cover and a large back cover, both having a top and a bottom. A large folding flap is joined to the top of the back cover in articulated fashion. The large folding flap is foldable over the top of the large front cover and unfordable to expose the top of the large front cover. Release able large front cover fasteners are located on the large front cover.

The large filing wallet is further comprised of a plurality of large file section dividers having opposing mutually parallel, large divider upper and lower edges and opposing, mutually parallel opposite large divider side edges oriented perpendicular to the large divider upper and lower edges. The large file section dividers are coupled to each other and to the large front and back covers with accordion folding pleated connections. The lower edges of the large file section dividers are closed, thereby forming a plurality of file pockets having dimensions of at least 8.5 by 11 inches between the large file section dividers and the large front and back covers.

The small filing wallet has a small front cover and a small back cover, both having a top and a bottom and both of which have dimensions of less than 8.5 by 11 inches. A small folding flap is joined to the top of the back cover in articulated fashion. The small folding flap is foldable over the top of the small front cover and unfordable to expose the top of the small front cover. Release able small back cover fasteners are located on the small back cover and are engage able with the large front cover fasteners located on the front cover of the large filing wallet.

In another broad aspect the invention may be considered to be a portable document storage device that includes: a large portable file folder, a pouch smaller than the large portable file folder, and detachable fasteners. The large portable file folder is formed of a large file base sheet upon which a large back file cover and a large foldable file flap are delineated. The large portable file folder also includes a large front cover and a plurality of large divider sheets. These large divider sheets have open upper edges and closed lower edges, as well as opposing side edges. The large divider sheets are disposed between the large front and back covers and are joined to each other and to the large front and back covers by a plurality of accordion folding pleats along their side edges.

The smaller pouch is formed of a pouch base sheet upon which a back pouch cover and foldable pouch flap are delineated. The smaller pouch also includes a front pouch cover having a top, a bottom, and opposing sides. A plurality of pleats at the bottom and opposing sides of the pouch front cover join it to the pouch back cover.

The detachable fasteners are comprised of members located on the large front cover and mating members located on the small pouch back cover. The detachable fasteners release ably join the large portable file folder and the smaller pouch together. The smaller pouch can thereby be attached to and carried enveloped within the large portable file folder. Alternatively, it may be completely detached therefrom and used independently from the large portable file folder.

In still another aspect the invention may be considered to be a wallet assembly comprising: a major document filing wallet; a minor document filing wallet; and release ably engage able fasteners for detachably coupling the major and minor wallets together. The major document filing wallet is formed of a first major base sheet folded to define a major wallet back cover having a top, bottom, and opposing sides, and a major wallet flap joined to the major wallet back cover at the top thereof. The major document filing wallet also includes a major wallet front cover having a top, bottom, and opposing sides. The bottoms of the major wallet covers are joined to each other by major wallet bottom closure means. Opposing major wallet side panels are each folded into a plurality of accordion pleats and joined to the sides of the major wallet covers to permit the major wallet covers to be collapsed toward each other and expanded away from each other. Major file dividers are located between the front and back covers and are fastened to the major wallet side panels at separate ones of the pleats therein. The provision of the major file dividers thereby creates a plurality of separate file pockets between the front and back covers.

Similarly, the minor filing wallet is formed of a first minor base sheet folded to define a minor wallet back cover having a top, bottom, and opposing sides. A minor wallet cover flap is joined to the minor wallet back cover at the top thereof. The minor filing wallet also includes a minor wallet front cover having a top, bottom, and opposing sides. The bottoms of the minor wallet covers are joined to each other by minor wallet bottom closure means. Opposing minor wallet side panels are each folded into a plurality of accordion pleats and joined to the sides of the minor wallet covers to permit the minor wallet covers to be collapsed toward each other and expanded away from each other. Minor file dividers are located between the minor front and back covers and fastened to the minor wallet side panels at separate ones of the pleats. The minor file dividers thereby create a plurality of separate file pockets between the minor wallet front and back covers.

The release ably engage able fasteners are located on the major wallet front cover and the minor wallet back cover. These fasteners may be engaged so that the minor wallet may be attached to the major wallet and enveloped between the major wallet front cover and the overlying major wallet cover flap. Alternatively, the release able fasteners may be detached from each other so that the minor wallet may be utilized independently from the major wallet.

The invention may be described with greater clarity and particularity with reference to the accompanying drawings.

DESCRIPTION OF THE DRAWINGS

FIG. 1 is a perspective view of one preferred embodiment of a portable document storage device according to the invention shown with the foldable file closure flap of the large file folder enveloping the smaller pouch or wallet which is hidden therewith in.

DESCRIPTION OF THE EMBODIMENT

Figure 1:
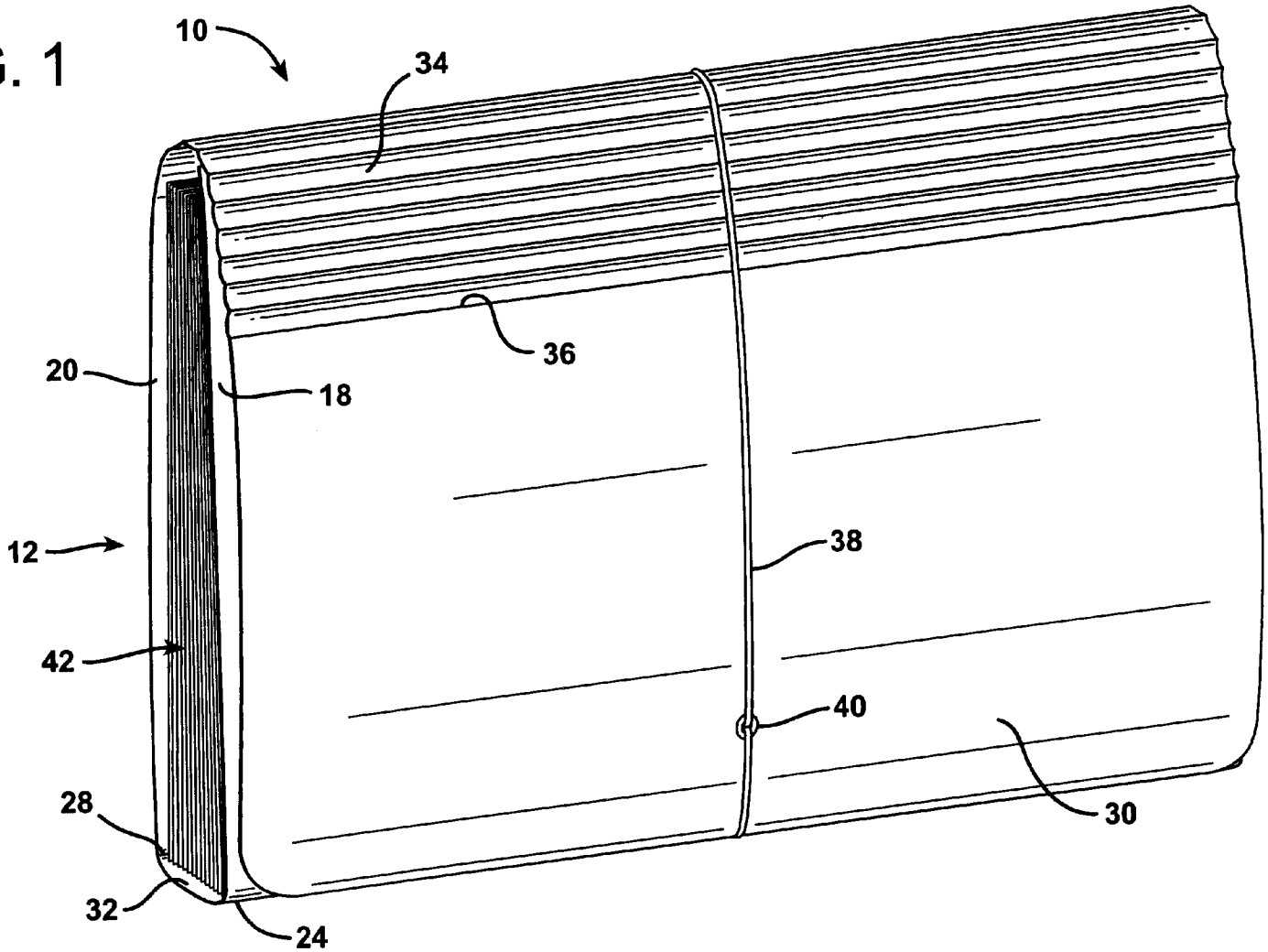
Figure 2:
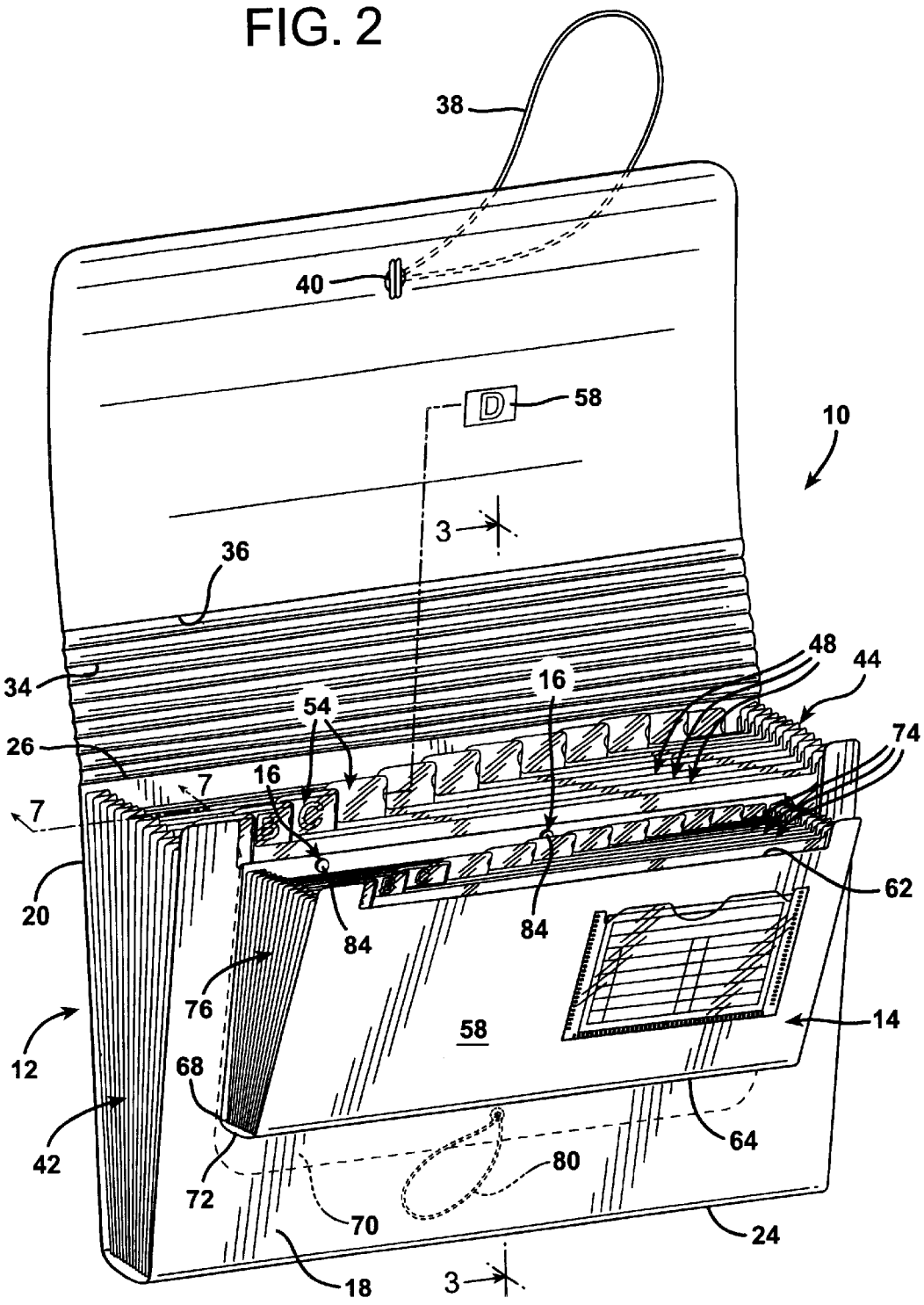
FIG. 2 is a perspective view of the portable document storage device of FIG. 1 shown with the flap of the large file open so that the small file is visible in a position attached to the large file.
Figure 3:
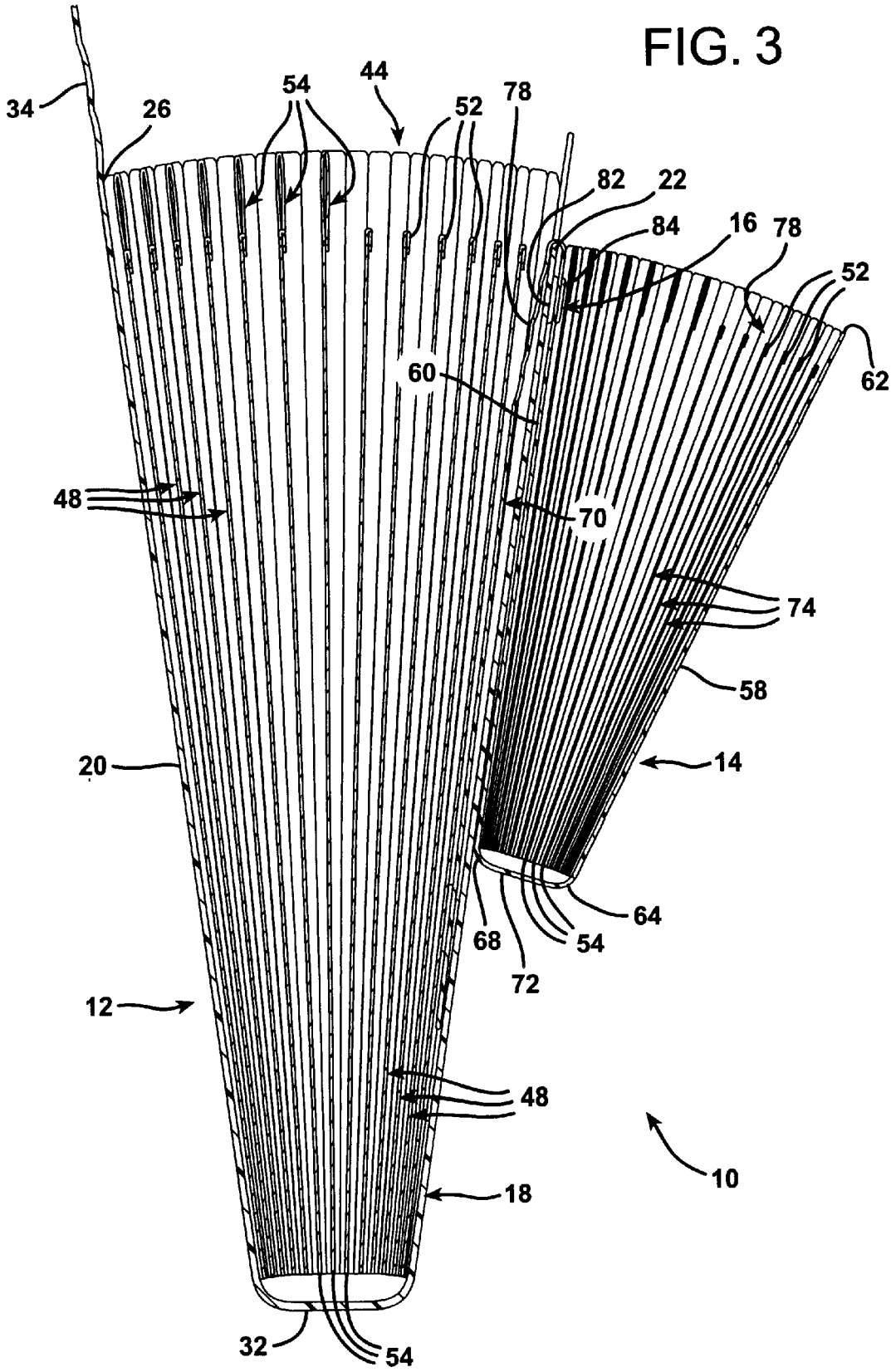
FIG. 3 is a side sectional view taken along the lines 3—3 of FIG. 2.
Figure 4:
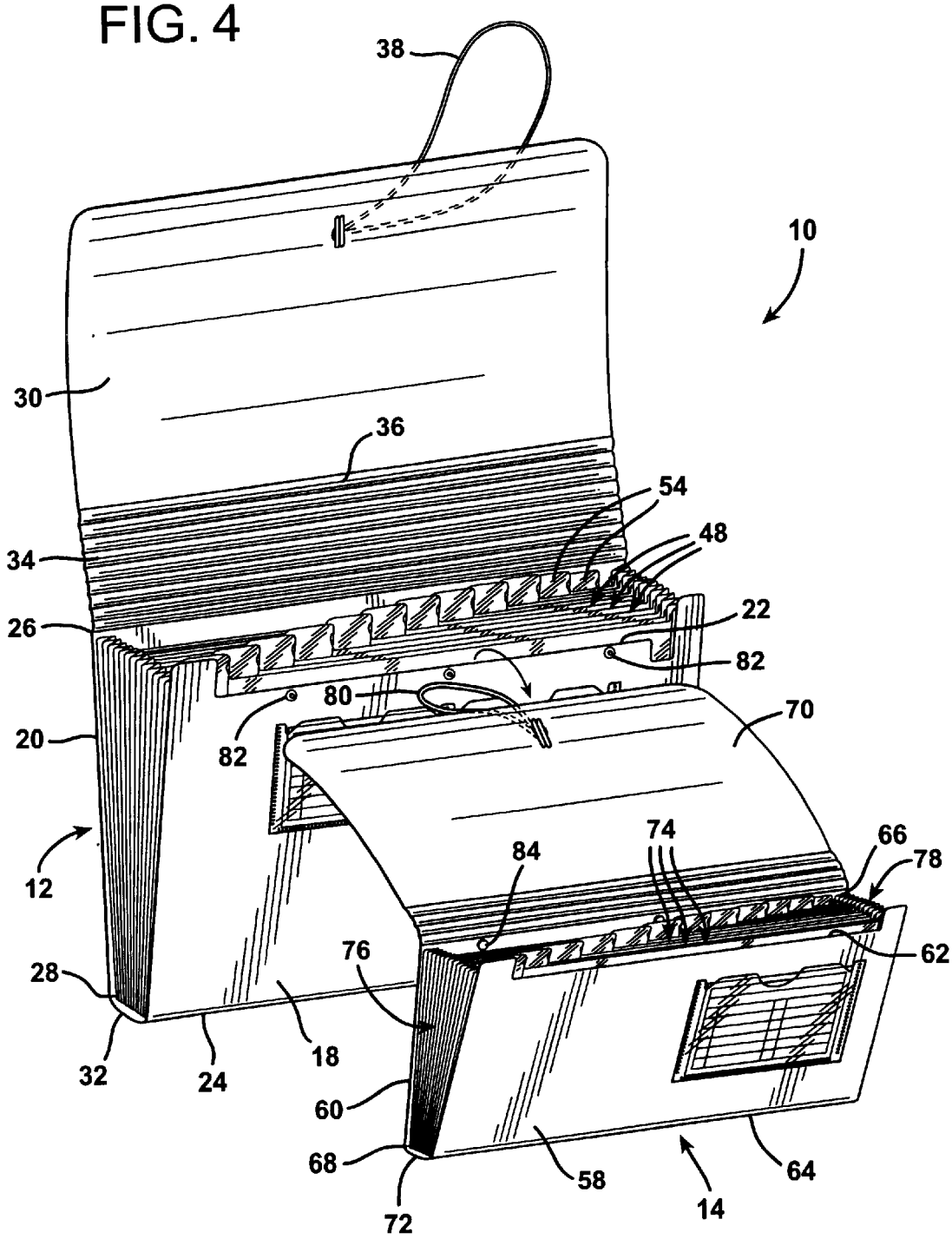
FIG. 4 is a perspective view illustrating the large and small file folders or wallets detached from each other.
Figure 5:
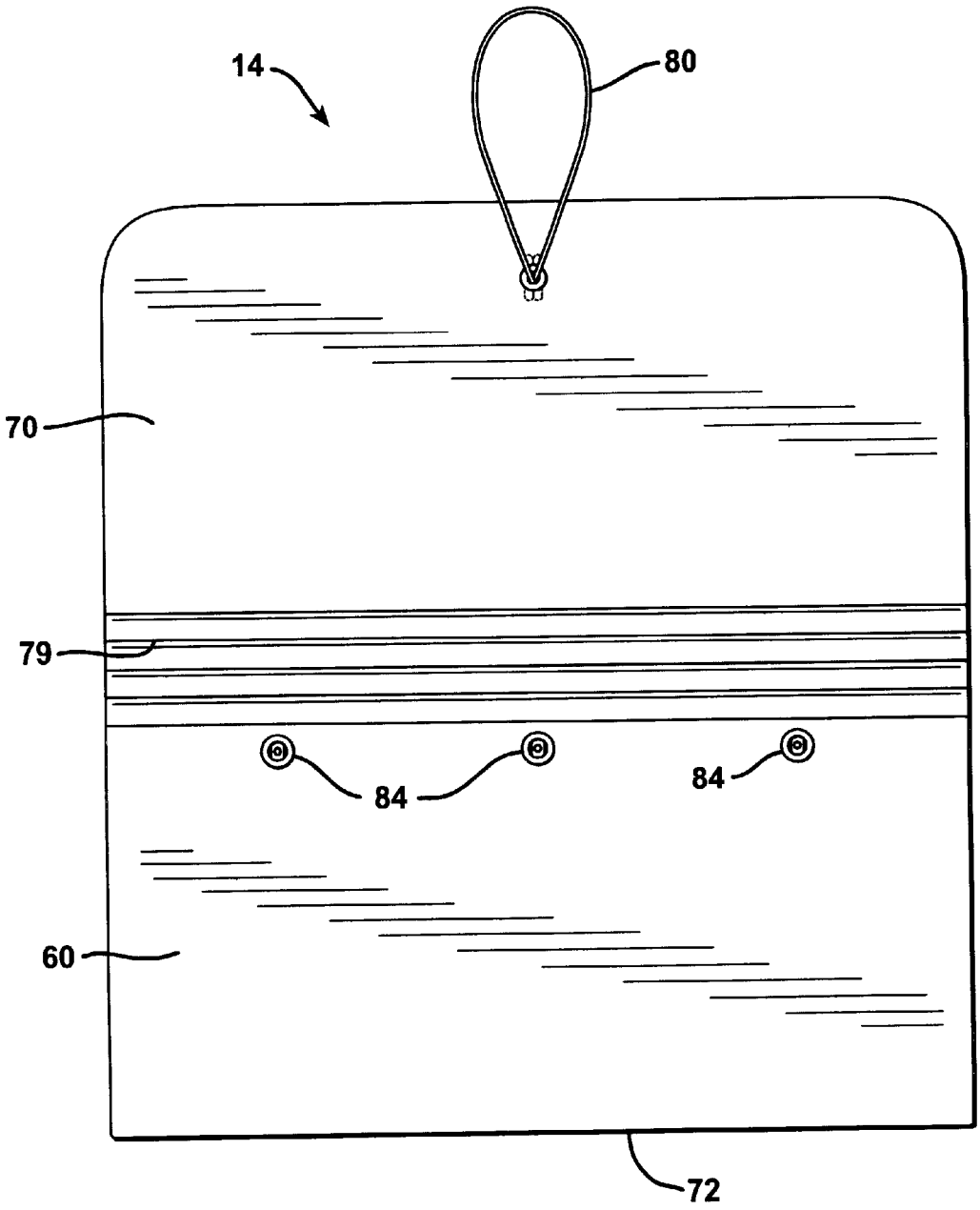
FIG. 5 is a rear elevation al view of the small filing wallet illustrated in FIG. 4.

FIG. 1 illustrates a portable document storage device 10 which, in fact, is the combination of a large filing wallet or folder 12, shown in FIGS. 1 and 2, and a smaller filing folder or wallet 14, which is hidden from view in FIG. 1, but which is visible in FIG. 2. As shown in FIGS. 3–5, the smaller filing wallet 14 is detachably coupled to the large filing wallet 12 by means of release ably engage able fasteners 16, which in the embodiment shown are metal snap fasteners.

As best illustrated in FIGS. 2 and 3, the large filing wallet 12 has a large, generally rectangular front cover 18 and a large, generally rectangular back cover 20, both having a top and a bottom. The top of the front cover 18 is indicated at 22 in FIGS. 3 and 4, while the bottom of the front cover 18 is indicated at 24. The top of the back cover 20 is indicated at 26, while the bottom of the back cover 20 is indicated at 28.

The large file folder 12 has a large folding flap 30 that is foldable over the top 22 of the large front cover 18, as illustrated in FIG. 1. In the embodiment of the portable storage device 10 illustrated in FIGS. 1–6, the large front cover 18, the large back cover 20, and the large folding flap 30 of the large filing wallet 12 are all formed as parts of a single base sheet of stiff, but flexible plastic material, such as polypropylene or polyethylene, preferably about fifty mils in thickness. In this embodiment a bottom closure panel 32 is also formed from the same single plastic base sheet and an articulated closure top 34 is also defined on the same base sheet of plastic between the back cover 20 and folding flap 30. The single stiff sheet of covering material is folded along the bottom edge 24 of the front cover 18 to delineate the front cover 18 from the bottom panel 32 and along the bottom edge 28 of the back cover 20 to delineate the bottom panel 32 from the back panel 20.

An articulated fold at the top edge 26 of the back panel 20 delineates the back cover 20 from the top panel 34. An articulated fold at 36 delineates the top panel 34 from the closure flap 30. The top panel 34 is formed with a series of articulated folds so as to accommodate various thicknesses of documents within the large file folder 12.

Figure 6:
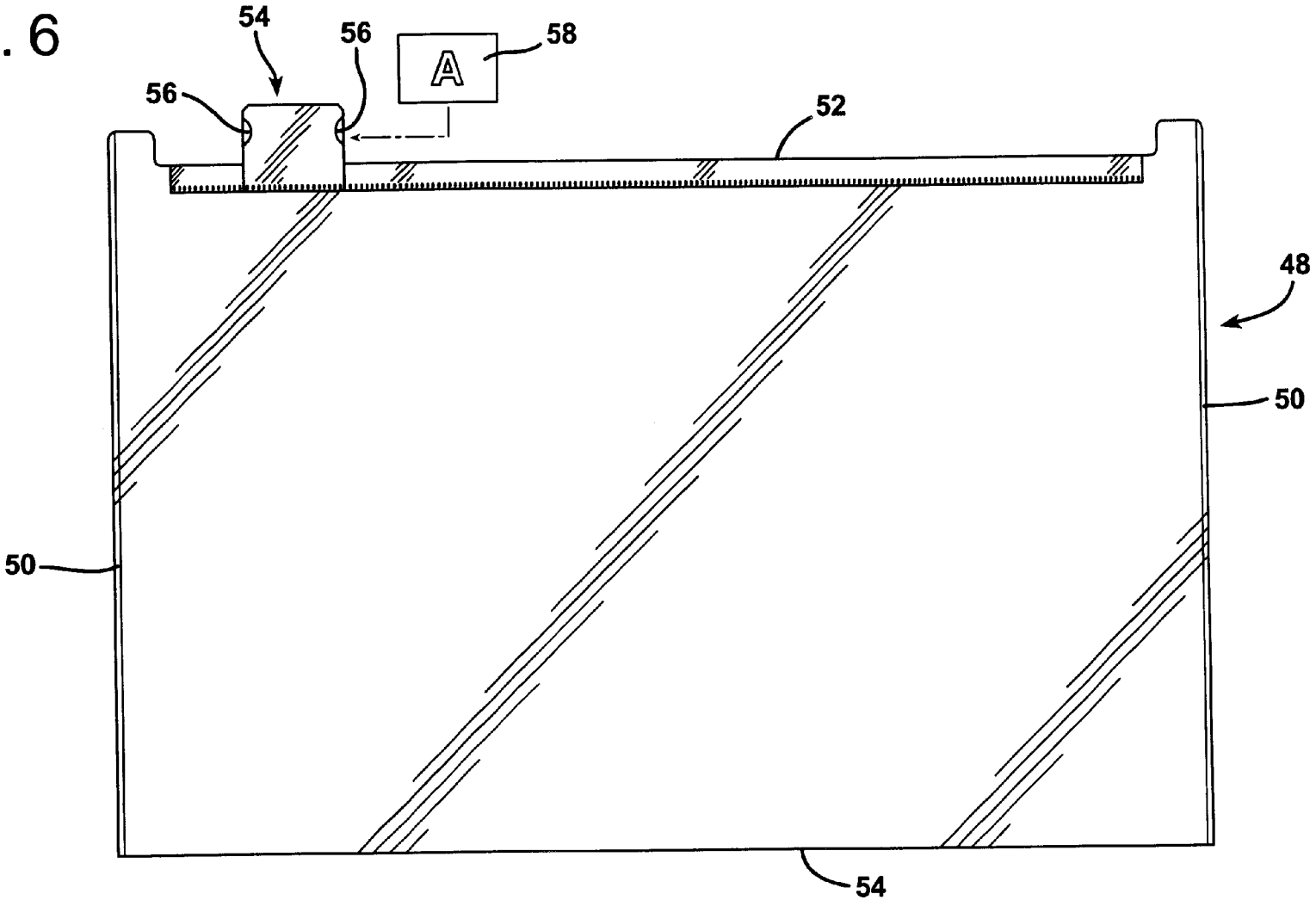
FIG. 6 is a front elevation al view of a single one of the large file section dividers employed in the portable document storage device of FIG. 1, shown in isolation.
Figure 7:
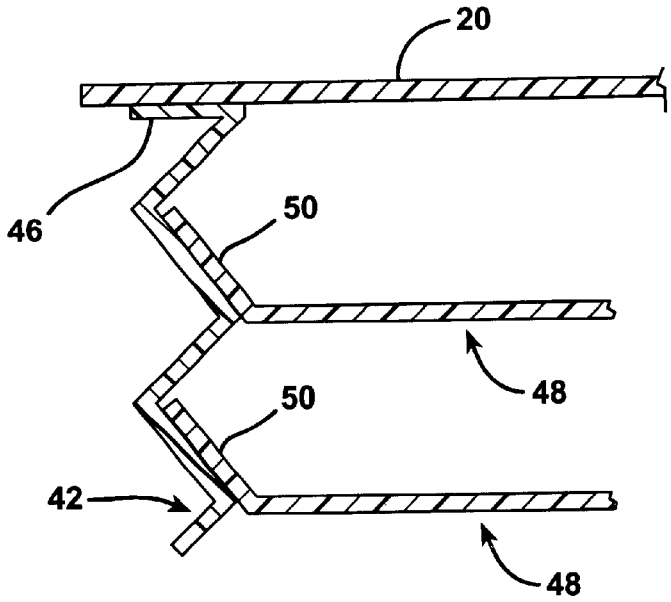
FIG. 7 is a sectional detail taken along the lines 7—7 of FIG. 2.

The folding flap 30 is provided with an elastic loop 38 that is secured at a grommet 40 near the free edge of the folding flap 30 remote from the delineating articulated fold 36. The elastic loop 38 can be stretched to envelope the entire structure of the portable document storage device 10 so that it can be transported in a very compact and secure manner as illustrated in FIG. 1. In this drawing view the smaller filing wallet 14 is completely encompassed within the large filing wallet 12 and is thereby hidden from view The large filing wallet 12 is also provided with large side panel sheets 42 and 44, also formed of polypropylene or polyethylene plastic. In the embodiment of the portable document storage device 10 depicted in drawing FIGS. 1–6, the large side panel sheets originally have a rectangular shape, but are folded back and forth along vertical folds in alternating directions to form a plurality of accordion pleats, as best illustrated in FIGS. 2, 4, and 7. Each fold in the side panel sheets 42 and 44 is about nine-sixteenths of an inch from the next adjacent fold. The front and back ends of each of the panels 42 and 44 form thin, narrow, elongated attachment strips 46. The opposing end margins of the large side panel sheets 42 and 44 that form the attachment strips 46 are folded to reside in intimate contact with the mutually facing surfaces of the large front and back covers 18 and 20. The attachment strips 46 are heat or sonic welded from top to bottom to the facing surfaces of the large back cover 20 and the large front cover 18, as best illustrated in the sectional detail view of FIG. 7. The strips 46 extend the entire length of the large side panel sheets 42 and 44 and are sealed from top to bottom throughout their lengths from near the bottom edges 24 and 28 to near the tops edges 22 and 26 of the large front cover 18 and large back cover 20, respectively.

The large portable file folder 12 is further comprised of large file section dividers 48 that are each formed of a separate sheet of plastic. FIG. 6 shows a single one of the large file section divider sheets 48 in elevation and in isolation. As illustrated in FIGS. 6 and 7, each of the large file section dividers 48 is folded at its transverse ends to form narrow, elongated side edge margin strips 50 which extend the entire height of the large file section dividers 48. The side edge margins 50 of the large file section dividers 48 are heat welded to the large side panel sheets 42 and 44 throughout between the upper and lower divider edges 52 and 54 of the large file section dividers 48, as best illustrated in FIG. 7.

The side edge margins 50 of the large divider sheets 48 are individually secured to the side panel sheets 42 and 44 at separate ones of the accordion folds, as illustrated in FIGS. 2, 4, and 7. Each large section file divider 48 has a generally rectangular configuration with a horizontal top edge 52 and a horizontal bottom edge 54. The large bottom panel 32 forms a closure member beneath the large file section dividers 48.

The interior portion of the top edge 52 may be recessed downwardly below the transverse extremities of each large file section divider sheet 48. Indexing label tabs 54 may be heat welded at different locations along the transverse width of the large file section dividers 48, as illustrated in FIGS. 2, 4, and 6. Each of the indexing tabs 54 is formed of a doubled over strip of plastic, the bottom edges of which are heat welded to the top edges 52 of the large file section dividers 48, as shown in FIG. 6. Small gripping notches 56 are provided at the opposing side edges of each tab 54 on one side thereof to facilitate separation of the two plies of plastic forming the tab 54 in order to insert thin paper labels 58 therein, as illustrated in FIG. 6. The file indexing tabs 54 thereby form a readily visible indexing system for the large file folder 12, as is evident from FIGS. 2 and 4.

The construction of the small filing wallet 14 is virtually identical to the construction of the large filing wallet 12, except for the size and shape of the component parts. That is, the small filing wallet 14 also has a small front cover 58 and a small back cover 60. The small front cover 58 has a top 62 and a bottom 64. The small back cover 60 has a top 66 and a bottom 68. The small filing wallet 14 also includes a single, stiff sheet of covering material, approximately fifty mils in thickness, that is folded to delineate the small front and back covers 58 and 60 and a small folding closure flap 70 therein. In the embodiment illustrated in FIGS. 1–6, the sheet forming the front and back covers 58 and 60 and the folding flap 70 also delineates a small wallet bottom panel 72 between the small front cover 58 and small back cover 60.

The small filing wallet 14 also is formed with a plurality of file section dividers 74 and small side panel sheets 76 and 78 that, like the large side panel sheets 42 and 44, have opposing end margins which are folded to reside in contact with the mutually facing surfaces of the small front cover 58 and small back cover 60. Like the opposing end margins 46 of the large side panel sheets 42 and 44, the end margins of the small side panel sheets 76 and 78 are heat welded to the mutually facing interior surfaces of the small front cover 58 and small back cover 60 of the small filing wallet 14, from top to bottom.

Like the large file section dividers 48, the small section dividers 74 have opposing, mutually parallel, upper small divider edges 52 and lower small divider edges 54, and opposing, mutually parallel opposite small divider edges that are oriented perpendicular to the small divider upper and lower edges 52 and 54. The small section dividers also have the same type of marginal edge strips 50 as the large file section dividers 48. These edge margin strips 50 of the small file section dividers 74 are heat or sonic welded to the accordion folded small side panels 76 and 78 so that the small file section dividers 74 are coupled to each other and to the small front cover 58 and the small back cover 60 with accordion folding pleated connections in the side panels 76 and 78. The small bottom panel 72 thereby forms a closure member beneath the small file section divider 74.

The principal difference in construction between the small filing wallet 14 and large filing wallet 12 is in the size of the file pockets formed by the small file section dividers 74. More specifically, while the large file section dividers 48, together with the accordion folded large side panels 42 and 44, form a plurality of file pockets in the large filing wallet 12 having dimensions of at least 8.5 by 11 inches between the large file sections dividers 48 and the large front and back covers 18 and 20, the file pockets of the small filing wallet 14 are much smaller. The small front cover 58 and the small back cover 60 have dimensions of less than 8.5 by 11 inches. Preferably, the small filing wallet 14 is constructed so that the small file section dividers 74, together with the accordion folded small side panels 76 and 78, form a plurality of small file pockets having dimensions considerably smaller than 8.5 by 11 inches, but preferably at least 4 by 5.75 inches between the small file section dividers 74 and the small front cover 58 and small back cover 60. Small filing pockets measuring about 4 by 5.75 inches are of a convenient size for storing papers that are encased within standard #10 size letter envelopes.

In the embodiment of the wallet assembly 10 illustrated in FIGS. 1–6, the bottoms 54 of the large file section dividers 48 and the bottoms 54 of the small file section dividers 74 are open and are not sealed to any other structure. However, the small bottom panel 72 forms a closure member for the pockets delineated between the small front cover 58 and small back cover 60 by the small file section dividers 74. The large bottom panel 32 forms a closure member beneath the large file section dividers 48 for the filing pockets delineated by the large file section dividers 48. In this way, papers inserted into the file pockets of the portable document storage device 10 rest upon the bottom panels 32 and 72 thereof, but are separated by the large file section dividers 48 and the small file section dividers 74.

The stiff sheet of material forming the small file front cover 58, the small file bottom panel 72, and the small file back cover 60 and the small folding flap 70 also delineates an articulated top panel 79 located between the top 66 of the small back cover 60 and the small folding closure flap 70. The top 79 is formed by a series of articulated folds so as to accommodate different thickness of papers within the small filing wallet 14. Like the large filing wallet 12, the small filing wallet 14 is provided with an elastic loop 80 that can be secured in the manner illustrated in FIG. 1. That is, the elastic loop 80 of the small filing wallet 14 can be looped around the entire cover structure of the small filing wallet 14 to hold the contents compactly therein, in the same manner as illustrated with respect to the large filing wallet 12 in FIG. 1.

The releaseable fasteners 16 employed in the portable document storage device 10 depicted in FIGS. 1–6 are conventional, metal snap fasteners. Three metal snap fasteners 16 are located at spaced intervals transversely across the portable document storage device 10. Each of the metal snap fasteners 16 has a male snap fastening member 82 and a female metal snap fastening member 84. The male snap fastening members 82 are permanently secured to the large front cover 18 near the top 22 thereof and have small metal posts projecting outwardly therefrom. The female metal snap fastening members 84 are visible in FIG. 5 and are formed with corresponding sockets faced rearward from the small back cover 60 and are aligned transversely near the top 66 thereof for corresponding engagement with the male metal snap fastening members 5 82. The members 82 and 84 of each of the metal snap fasteners 16 are engaged in the manner illustrated in FIG. 3. As also shown in that drawing figure, the small folding flap 70 of the small filing wallet 14 is short enough so that it can be folded over the recessed central portion of the top 22 of the large front cover 18 of the large filing wallet 12. As shown, the small folding flap 70 can be positioned to extend down into the front filing pocket of the large filing wallet 12 delineated between the backside of the large front cover 18 and the large file divider 48 located immediately adjacent thereto, as illustrated in FIG. 3.

As shown in FIGS. 2 and 3, the large filing wallet 12 and small filing wallet 14 can be engaged with each other by the snap fasteners 16 and utilized together. The pleated accordion folds of the large side panels 42 and 44 of the large filing wallet 12 and the small side panel 76 and 78 of the small filling wallet 14 allow the front covers to be pulled away from the back covers of both of the filing wallets 12 and 14 to expose the contents thereof and permit withdrawal and insertion of documents, as illustrated in FIGS. 2 and 3. Alternatively, the release able snap fastening members 82 and 84 can be readily pulled apart so that the small filing wallet 14 can be detached from the large filing wallet 12, as illustrated in FIG. 4. The filling wallets 12 and 14 can thereupon be used totally independently of each other.

The large folding flap 30 that is joined to the top 26 of the large back cover 20 by means of the articulated top panel 34 is foldable over the top of the large front cover 18, as illustrated in FIG. 1, and is unfordable as illustrated in FIGS. 2–4 to expose the top 22 of the large front cover 18, and thereby expose all of the file pockets delineated between the large file section dividers 48, the large front cover 18, and the large back cover 20.

Likewise, the small folding flap 70 is joined to the top 66 of the small back cover 60 in articulated fashion, by means of the articulated top panel 79. The small folding flap 70 is thereby foldable over the top 62 of the small front cover 68 in the same manner as illustrated in FIG. 1 with respect to the large filing wallet 12. The small folding flap 70 is also unfordable to expose the top 62 of the small front cover 58, as illustrated in FIGS. 2, 3, and 4.

Figure 8:
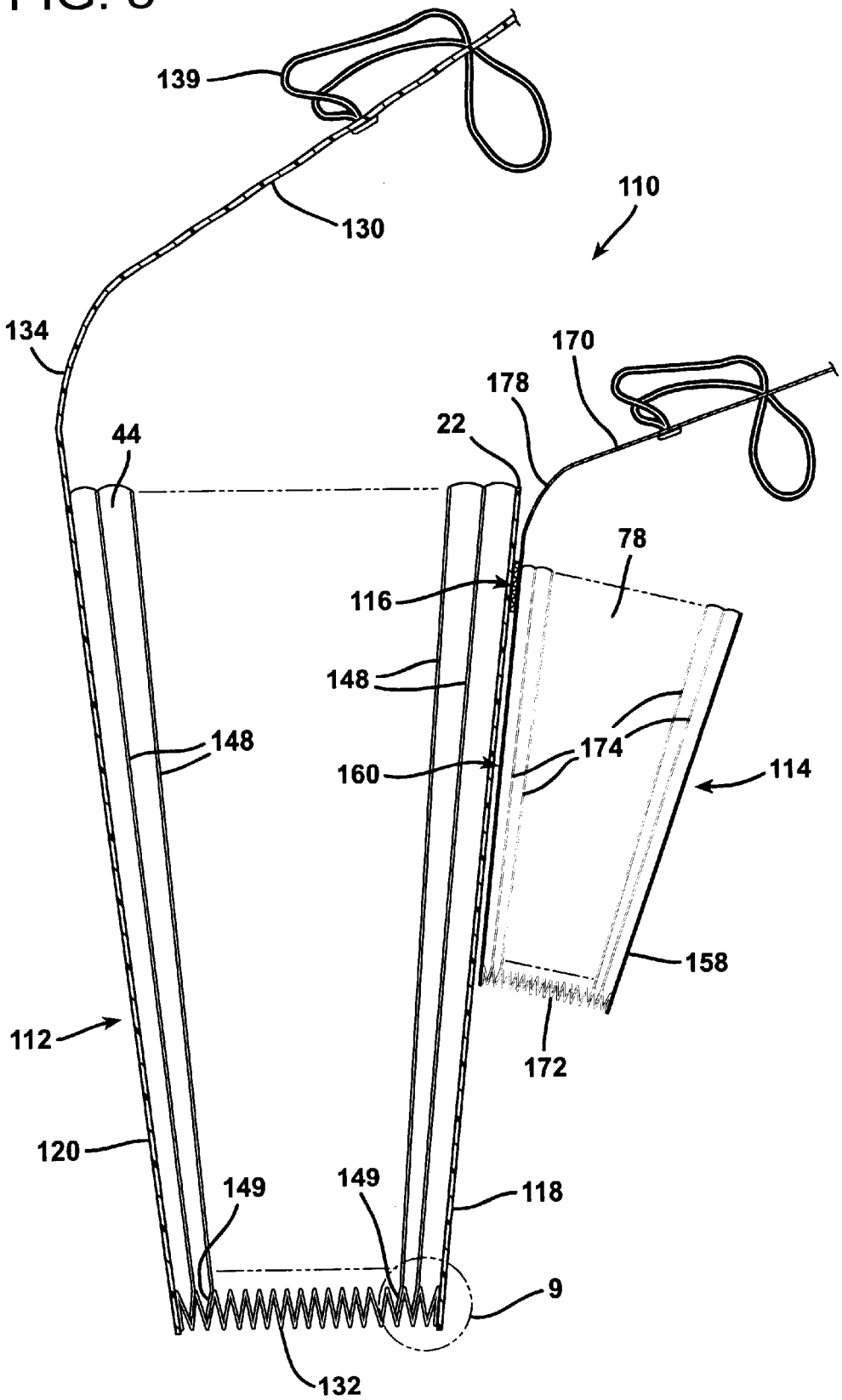
FIG. 8 is a side sectional view, comparable to the view of FIG. 3, illustrating an alternative embodiment of a portable document storage device according to the invention.

FIG. 8 illustrates an alternative embodiment of a wallet assembly 110 according to the invention. In the embodiment illustrated in that drawing figure, the portable document storage device 110 includes a large portable file folder 112 formed of a large file base sheet upon which a large back file cover 120, an articulated top panel 134, and a foldable large file closure flap 130 are delineated. The large file folder 112 also includes a large front cover 118 that is formed by a separate front sheet of stiff plastic material. As in the portable document storage device 10, the large file folder 112 is further comprised of a pair of large side panel sheets 42 and 44 folded from top to bottom with a plurality of accordion folds, but also includes a large bottom panel sheet 132 folded transversely with a plurality of accordion folds, as illustrated in FIG. 8. The large filing wallet 112 includes large divider sheets 148 which are substantially the same size and shape as the large divider sheets 48 in that they have side edge margins 50 that are individually secured to the large side panels sheets 42 and 44 at separate ones of the accordion folds. In addition, however, the large divider sheets 148 also have bottom edge margins 149 that are individually secured to the large bottom panel sheet 132 at separate ones of the accordion folds therein, as illustrated in the sectional detail of FIG. 9. This construction allows the bottom of the large file folder 112, as well as the top thereof, to be expanded forwardly and rearward. In this construction, the bottom edges of the large file sections dividers 148 are not free, but are secured to the accordion-folded bottom panel 132.

Figure 9:
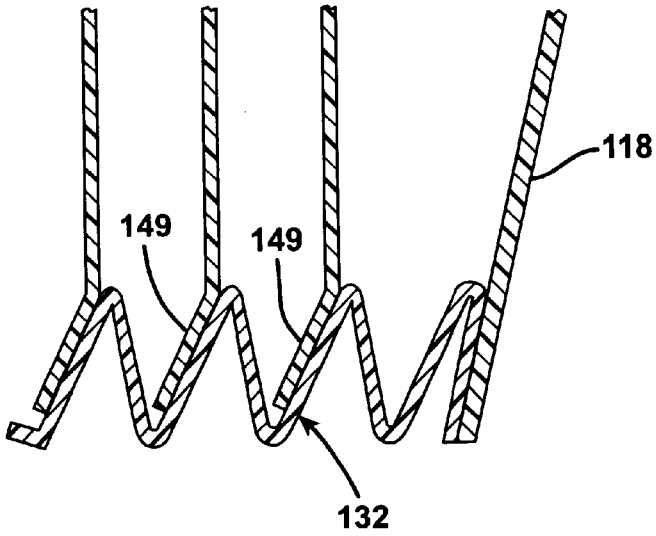
FIG. 9 is a sectional detail indicated at 9 in FIG. 8.

The small filing wallet 114 illustrated in FIG. 8 has the same type of construction, but with reduced dimensions. That is, the small filing wallet 114 is formed of a base sheet that defines a small or minor back cover 160, an articulated top panel 178, and a small or minor wallet closure flap 170. The small or minor wallet front cover 158 is formed of the same type of stiff, plastic material as the back cover 160, but is formed in a separate sheet. The small filing wallet 114 also has a small or minor bottom closure panel 172 that is formed of a separate sheet of material from the covers 158 and 160 and which is folded into a plurality of accordion pleats, as illustrated in FIG. 8. The small or minor file dividers 174, like the small file dividers 74 in the embodiments of FIGS. 1–6, include narrow, elongated side marginal strips that are secured to the accordion pleated side panels 76 and 78 in the same manner as illustrated and described in connection with the embodiment of FIGS. 1–6. However, the small or minor file dividers 174, like the large file dividers 148, are provided with transversely extending bottom strips that are secured to the pleats of the small bottom panel 172 in the same manner as illustrated in FIG. 9.

One further difference in the wallet assembly 110 from that of the wallet assembly 10 is the type of release able fasteners used to secure the small back cover 160 of the small filing wallet 114 to the large front cover 118 of the large filing wallet 112. In this embodiment the release ably fasteners employed are comprised of flexible fabric hook and loop fastening members such as those sold under the registered trademark Velcro®. Interchangeable patches of the male fastening members having projecting, flexible hooks may be attached to the backside of the small back cover 160 of the small filing wallet 114, while pads of resilient pile engage able with those hooks are permanently attached to the forwardly facing surface of the large front cover 118 near the upper edge 22 thereof. When the mating flexible hook and loop fastening pads of the small filing wallet 114 are pressed against the corresponding mating pads of the large filing wallet 112, the small and large filing wallets 114 and 112 will be detachably coupled together. When desired, however, the small filing wallet 114 may be detached from the large filing wallet 112 by merely pulling the mating fabric hook and loop pads apart from each other.

Figure 10:
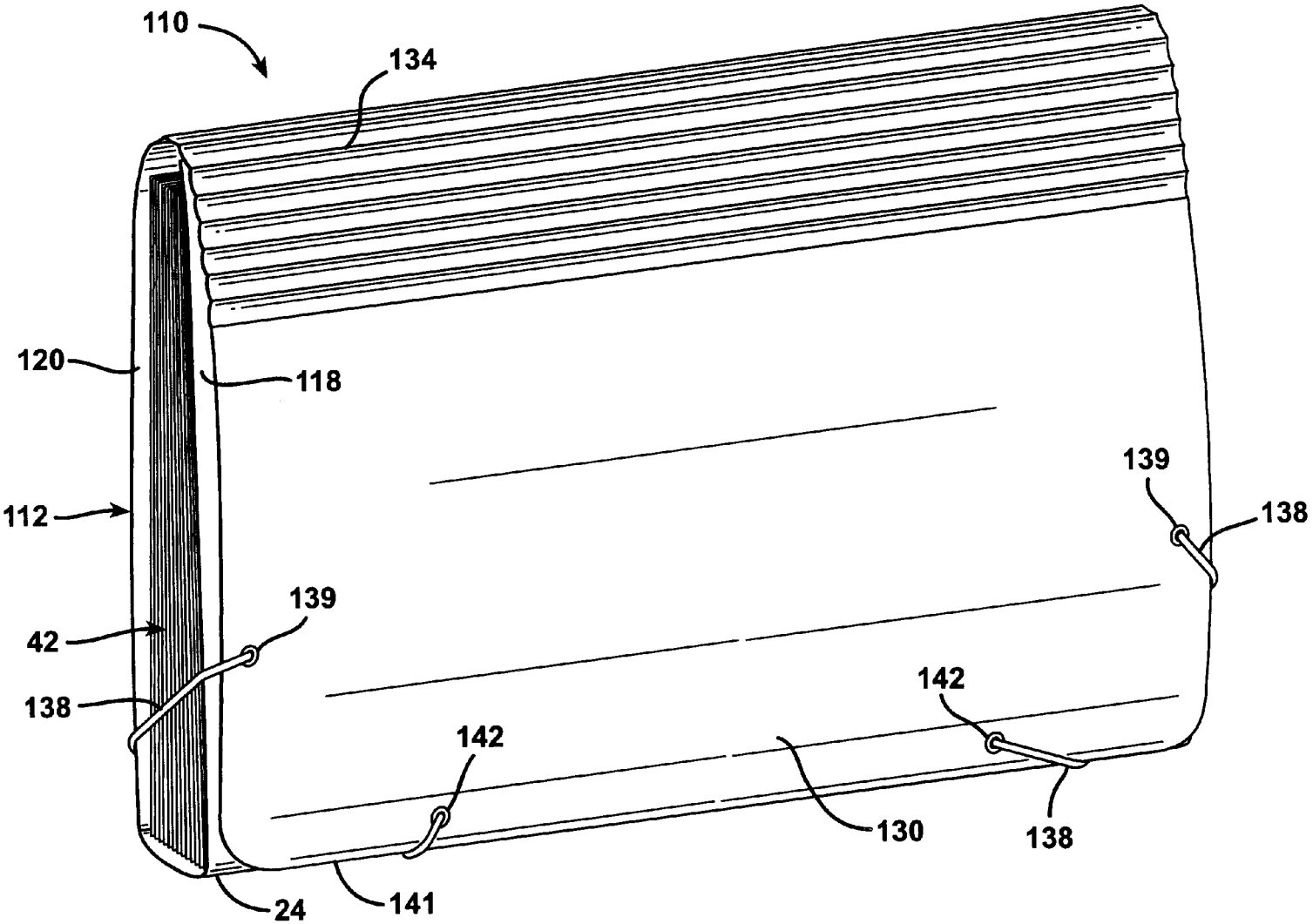
FIG. 10 illustrates in perspective the portable document storage device shown in the embodiment of FIG. 8.

FIG. 10 illustrates an alternative closure fastening arrangement for enclosing the small filing wallet 114 within the large filing wallet 112. As shown, instead of an elastic loop being secured to encircle the large filing wallet from top to bottom, an elastic fastening line 138 may be employed instead. The elastic fastening line 138 is secured at its opposite ends near the opposite side edges of the large folding flap 130 and passes through apertures 139 outwardly and downwardly to reenter the large folding closure flap 130 near the free edge 141 thereof through apertures 142. The elastic line 138 thereupon extends on the underside of the large folding flap across the central region thereof. The two exposed portions of the elastic fastening line 138 may be stretched diagonally outwardly away from the apertures 141 and 142 on each side of the large folding flap 130, and looped around the lower rear edges of the back cover 120 in the manner illustrated in FIG. 10. The smaller filing wallet may include a similar closure member.

Undoubtedly, numerous other variations and modifications of the invention will become readily apparent to those familiar with portable office filing products. For example, flexible hook and loop fabric fastening members may be utilized in place of the elastic loops 38 and 80. Also, the wallets can be constructed of paper or paper board rather than plastic. Other variations of the invention are also possible. Accordingly, the scope of the invention should not be construed as limited to the specific embodiments depicted and described, but rather as defined in the claims appended hereto.

I claim:

1. In combination, a large filing wallet having a large front cover and a large back cover both having a top and a bottom, and a large folding flap joined to said top of said large back cover in articulated fashion, whereby said large folding flap is foldable over said top of said large front cover and unfordable to expose said top of said large front cover, and release able large front cover fasteners are located on said large front cover, and further comprising a plurality of large file section dividers having opposing mutually parallel, large divider upper and lower edges and opposing, mutually parallel large divider side edges oriented perpendicular to said large divider upper and lower edges and said large file section dividers are coupled to each other and to said large front and back covers with accordion folding pleated connections, and said lower edges of said of large file section dividers are closed, thereby forming a plurality of file pockets having dimensions of at least 8.5 by 11 inches between said large file section dividers and said large front and back covers, and a small filing wallet having a small front cover and a small back cover both having a top and a bottom and both of which have dimensions of less than 8.5 by 11 inches, and a small folding flap joined to said top of said small back cover in articulated fashion, whereby said small folding flap is foldable over said top of said small front cover and unfoldable to expose said top of said small front cover, and release able small back cover fasteners that are engage able with said large front cover fasteners are located on said small back cover.

2. A combination according to claim 1 wherein said small filing wallet has a plurality of small file section dividers having opposing mutually parallel small divider upper and lower edges and opposing, mutually parallel small divider side edges oriented perpendicular to said small divider upper and lower edges and said small file section dividers are coupled to each other and to said small front and back covers with accordion folding pleated connections, and said bottom edges of said small file section dividers are closed, thereby forming a plurality of small file pockets having dimensions of at least 4 by 9.75 inches between said small file section dividers and said small front and small back covers.

3. A combination according to claim 2 wherein said small wallet includes a single, stiff sheet of covering material that is folded to delineate said small front and back covers and said small folding flap, and which is folded further to delineate a small wallet bottom panel between said small front and back covers and said small bottom panel thereby forms a closure member beneath said small file section dividers.

4. A combination according to claim 1 wherein said large wallet includes a single, stiff sheet of covering material that is folded to delineate said large front and back covers and said large folding flap, and which is folded further to delineate a large wallet bottom panel between said large front and back covers and said large bottom panel thereby forms a closure member beneath said large file section dividers.

5. A combination according to claim 1 further comprising a pair of large side panel sheets folded from top to bottom with a plurality of accordion folds, and wherein said large file section dividers are formed of large divider sheets having side edge margins that are individually secured to said side panel sheets at separate ones of said accordion folds in said side panel sheets.

6. A combination according to claim 5 wherein both said large side panel sheets and said large file section dividers are formed of sheets of plastic, and said side edge margins of said large divider sheets are heat welded to said large side panel sheets throughout between said large divider upper and lower edges of said large file section dividers.

7. A combination according to claim 6 wherein said large front and back cover and said large folding flap are formed of at lease one sheet of plastic and said large side panel sheets have opposing end margins which are folded to reside in contact with said large front and back covers and are heat or sonic welded thereto from top to bottom.

8. A combination according to claim 1 wherein said release able large front cover fasteners and said release able small back cover fasteners are comprised of interchangeable, flexible fabric hook and loop fastening members.

9. A combination according to claim 1 wherein said release able large front cover fasteners and said release able small back cover fasteners are comprised of metal snap fastening members.

10. A portable document storage device including:

a large portable file folder formed of a large file base sheet upon which a large back file cover and a large foldable file flap are delineated, a large front cover, and a plurality of large divider sheets having open upper edges and closed lower edges and opposing side edges and which are disposed between said large front and back covers and joined to each other and to said large front and back covers by a plurality of accordion folding pleats along said side edges, a pouch smaller than said large portable file folder and formed of a pouch base sheet upon which a back pouch cover and foldable pouch flap are delineated, a front pouch cover having a top, a bottom and opposing sides, and at least one pleat at said bottom and opposing sides of said front pouch cover joining it to said pouch back cover, and detachable fasteners on said large front cover and on said pouch back cover release ably joining said large portable file folder and said pouch together.

11. A portable document storage device according to claim 10 wherein said large file back cover, said large file flap and said large file front cover are all formed by delineating, articulated folds as sections of said large file base sheet, which further delineates a large file bottom panel between said large file back cover and said large file front cover.

12. A portable document storage device according to claim 11 further comprising a pair of large side panel sheets folded from top to bottom with a plurality of accordion folds, and wherein said large divider sheets have side edge margins that are individually secured to said side panel sheets at separate ones of said accordion folds.

13. A portable document storage device according to claim 12 wherein both said large side panel sheets and said large file section dividers are formed of sheets of plastic, and said side edge margins of said large side panel sheets are sonic welded to said large side panel sheets throughout between said upper and lower edges of said large file divider sheets.

14. A portable document storage device according to claim 13 to wherein said large front and back cover and said large folding flap are formed of sheets of plastic and said large side panel sheets have opposing end margins which are folded to reside in contact with said large front and back covers and are heat welded thereto from top to bottom.

15. A portable document storage device according to claim 10 wherein said large back file cover and said large file flap are both formed by a delineating fold as sections of said large file base sheet and said large front cover is formed by a separate large front sheet and further comprising a pair of large side panel sheets folded from top to bottom with a plurality of accordion folds, and a large bottom panel sheet folded transversely with a plurality of accordion folds, and wherein said large divider sheets have side edge margins that are individually secured to said large side panel sheets at separate ones of said accordion folds therein and bottom edge margins that are individually secured to said large bottom panel sheet at separate ones of said accordion folds therein.

16. A portable document storage device according to claim 15 wherein said large front and back cover and said large folding flap are formed of sheets of plastic and said large side panel sheets have opposing end margins which are folded to reside in contact with said large front and back covers and are sonic welded thereto from top to bottom.

17. A portable document storage device according to claim 10 wherein said pouch has a plurality of small file section dividers having opposing mutually parallel, small divider upper and lower edges and opposing, mutually parallel small divider side edges oriented perpendicular to said small divider upper and lower edges and said small file section dividers are coupled to each other and to said small front and back covers with accordion folding pleated connections, and said bottom edges of said of small file section dividers are closed, thereby forming a plurality of small file pockets having dimensions of less than 8.5 by 11 inches and at least 4 by 9.75 inches between said small file section dividers and said small front and small back covers.

18. A wallet assembly comprising:

a major document filing wallet formed of a first major base sheet folded to define a major wallet back cover having a top, bottom and opposing sides and a major wallet cover flap joined to said major wallet back cover at said top thereof, a major wallet front cover having a top, bottom and opposing sides, and wherein said bottoms of said major wallet covers are joined to each other by major wallet bottom closure means, and further comprising opposing major wallet side panels each folded into a plurality of accordion pleats and joined to said sides of said major wallet covers to permit said major wallet covers to be collapsed toward each other and expanded away from the each other, and major file dividers are located between said major front and back covers and fastened to said major wallet side panels at separate ones of said pleats therein, thereby creating a plurality of separate file pockets between said major wallet front and back covers, a minor filing wallet formed of a first minor base sheet folded to define a minor wallet back cover having a top, bottom and opposing sides and a minor wallet cover flap joined to said minor wallet back cover at said top thereof, a minor wallet front cover having a top, bottom and opposing sides, and wherein said bottoms of said minor wallet covers are joined to each other by minor wallet bottom closure means, and further comprising opposing minor wallet side panels each folded into a plurality of accordion pleats and joined to said sides of said minor wallet covers to permit said minor wallet covers to be collapsed toward each other and expanded away from each other, and minor file dividers are located between said minor front and back covers and fastened to said minor wallet side panels at separate ones of said pleats, thereby creating a plurality of separate file pockets between said minor wallet front and back covers, and release ably engage able fasteners located on said major wallet front cover and said minor wallet back cover for detachably coupling said major and minor wallets together.

19. A wallet assembly according to claim 18 wherein said minor filing wallet has a plurality of minor file section dividers having opposing mutually parallel, upper and lower minor divider edges and opposing, mutually parallel minor divider side edges oriented perpendicular to said upper and lower minor divider edges and coupled to each other and to said minor front and back covers with accordion folding pleated connections, and said bottom edges of said of minor file section dividers are closed, thereby forming a plurality of minor file pockets having dimensions of at least 4 by 9.75 inches between said minor file section dividers and said minor front and minor back covers and wherein said minor wallet includes a single, stiff sheet of covering material that is folded to delineate said minor front and back covers and said minor folding flap therein, and which is folded further to delineate a minor wallet bottom panel between said minor wallet front and back covers and said minor wallet bottom panel thereby forms said minor bottom closure means beneath said minor file section dividers, and further comprising a pair of major wallet side panel sheets folded from top to bottom with a plurality of accordion folds, and wherein said major file dividers are formed of major divider sheets having side edge margins that are individually secured to said major wallet side panel sheets at separate ones of said accordion folds.

20. A wallet assembly according to claim 18 wherein said minor filing wallet has a plurality of minor file dividers having opposing mutually parallel minor divider upper and lower edges and opposing, mutually parallel minor divider side edges oriented perpendicular to said minor divider upper and lower edges and said minor file dividers are coupled to each other and to said minor front and back covers with accordion folding pleated connections, and said bottom edges of said of minor file dividers are closed, thereby forming a plurality of minor file pockets having dimensions of at least 4 by 9.75 inches between said minor file dividers and said minor wallet front and back covers and wherein said major wallet back cover and said major wallet cover flap are both formed by a delineating fold as sections of said first major base sheet and said major wallet front cover is formed by a separate front sheet, and said major wallet side panels are comprised of a pair of major wallet side panel sheets folded from top to bottom with a plurality of accordion folds to form said accordion pleats, and further comprising a major bottom panel sheet folded transversely with a plurality of accordion folds, and wherein said major file dividers are formed of major divider sheets having side edge margins that are individually secured to said major wallet side panel sheets at separate ones of said accordion folds therein and bottom edge margins that are individually secured to said major bottom panel sheet at separate ones of said accordion folds therein, and wherein said first major base sheet and said major wallet front cover are formed of sheets of plastic and said major side panel sheets have opposing edge margins which are folded to reside in contact with said major front and back covers and are heat welded thereto from top to bottom.

* * * * *